US007625075B2

(12) United States Patent
Faase et al.

(10) Patent No.: US 7,625,075 B2
(45) Date of Patent: Dec. 1, 2009

(54) ACTUATOR

(75) Inventors: Kenneth James Faase, Corvallis, OR (US); Adel Jilani, Corvallis, OR (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 373 days.

(21) Appl. No.: 11/831,542

(22) Filed: Jul. 31, 2007

(65) Prior Publication Data

US 2009/0033718 A1 Feb. 5, 2009

(51) Int. Cl.
*B41J 2/045* (2006.01)

(52) U.S. Cl. ..... 347/68

(58) Field of Classification Search ..... 347/68, 347/69–72; 400/124.14–124.17, 124.23; 310/323.06, 323.08, 324, 331
See application file for complete search history.

(56) References Cited

U.S. PATENT DOCUMENTS 6,481,833 B1 11/2002 Fujii
6,575,565 B1 6/2003 Isono et al.
7,374,277 B2 * 5/2008 Nakayama ..... 347/68
7,441,874 B2 * 10/2008 Sugahara ..... 347/68
2002/0196315 A1 12/2002 Isono et al.
2006/0146096 A1 * 7/2006 Wright et al. ..... 347/68
2006/0232638 A1 10/2006 Kuroda

FOREIGN PATENT DOCUMENTS

JP 11-254669 9/1999
JP 2006-035571 2/2006

OTHER PUBLICATIONS

International Search Report for Application No. PCT/US2008/071540. Report issued Dec. 24, 2008.

* cited by examiner

*Primary Examiner*—K. Feggins

(57) ABSTRACT

In one embodiment an electrostatic actuator includes: a first conductor associated with each chamber; a second conductor having a plurality of flexible first parts supported by a plurality of second parts, each flexible first part forming at least part of a wall of each chamber and each flexible first part located opposite a corresponding one of the first conductors across a gap; and a voltage source operatively connected to each of the first conductors for selectively applying a voltage between each of the first conductors and the second conductor In another embodiment, an electrostatic actuator includes: a plurality of rigid conductors arranged adjacent to one another along a chamber; and a flexible conductor disposed opposite to and spanning the plurality of first conductors across a gap, the flexible conductor forming at least part of one wall of the chamber such that flexing the flexible conductor flexes the wall to change the volume of the chamber.

16 Claims, 15 Drawing Sheets

ACTUATOR

BACKGROUND

Piezoelectric actuated inkjet printheads are used for very large format inkjet printing applications, such as the industrial printing market for large signage. Piezoelectric materials, however, are difficult to process using conventional semiconductor wafer fabrication techniques. In conventional piezo actuator fabrication, a saw is used to pattern the material for subsequent etching. Lengthy saw times are used and the size of piezo features is limited by the saw tooling.

DRAWINGS

Figure 2:
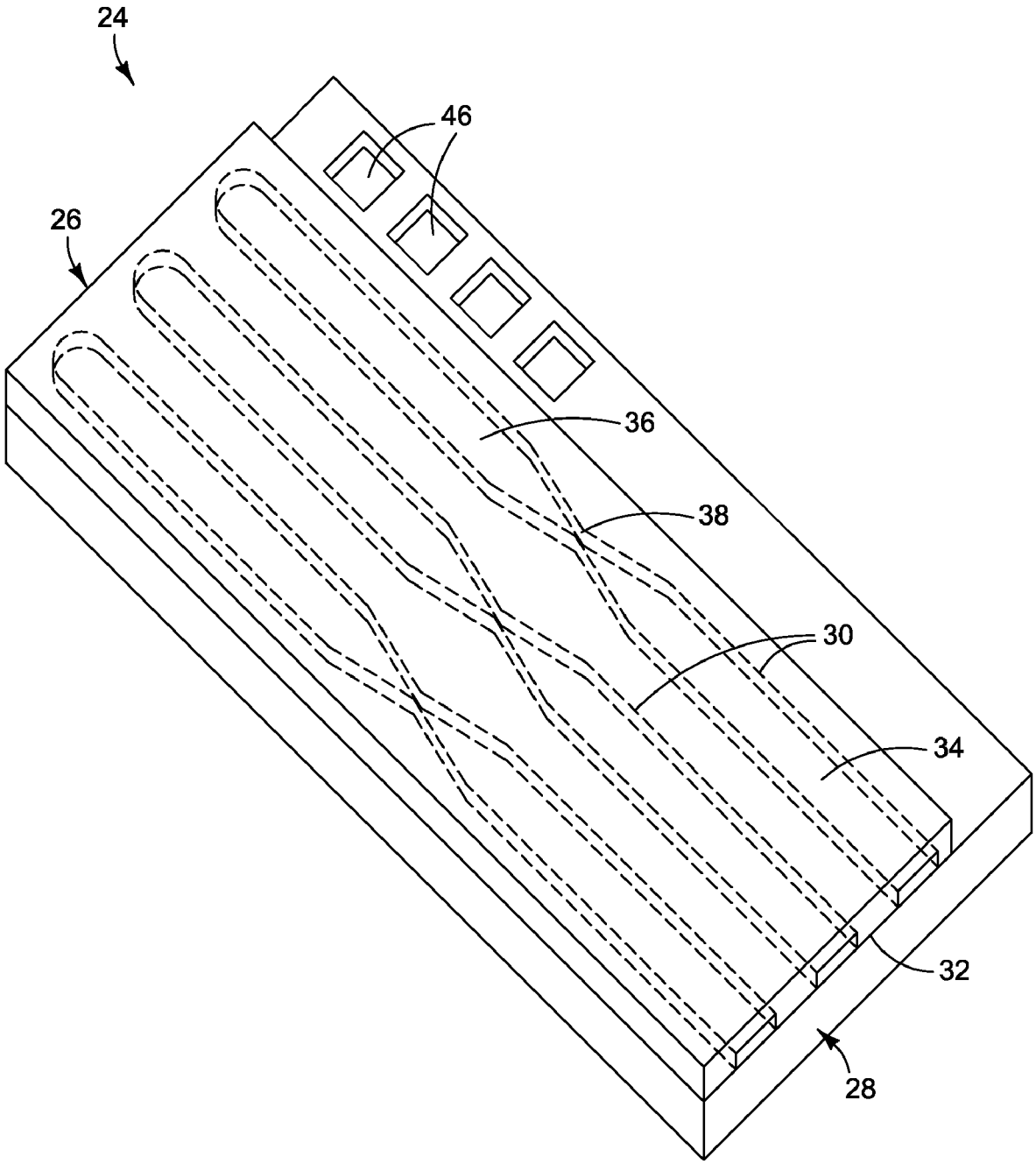
FIG. 2 is a perspective view illustrating one embodiment of an inkjet printhead that may be used in the printhead array in the printer shown in FIG. 1.
Figure 3:
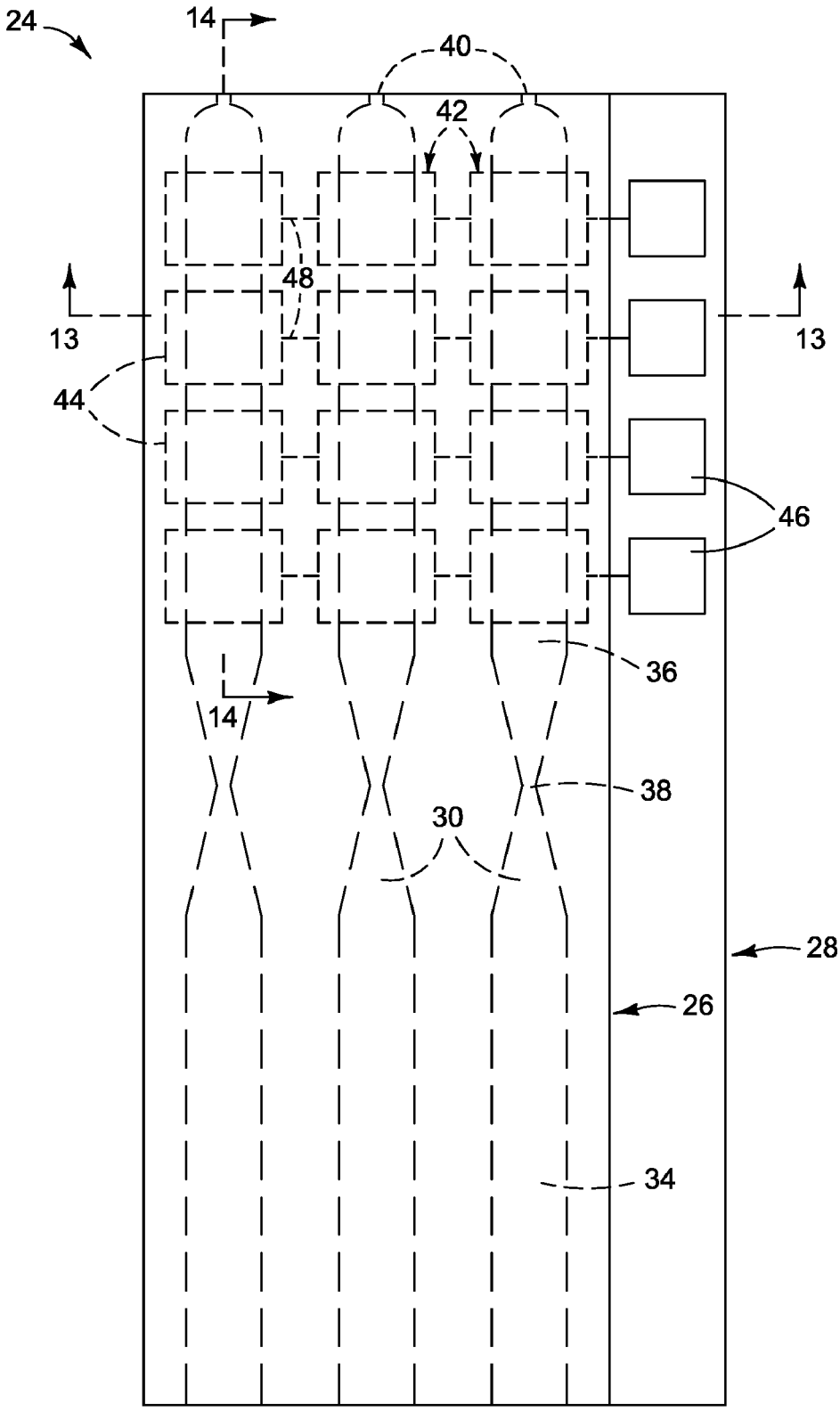
FIG. 3 is a plan view of the printhead of FIG. 2 illustrating an embodiment of the layout of the ink channels and control conductors.
Figure 4A:
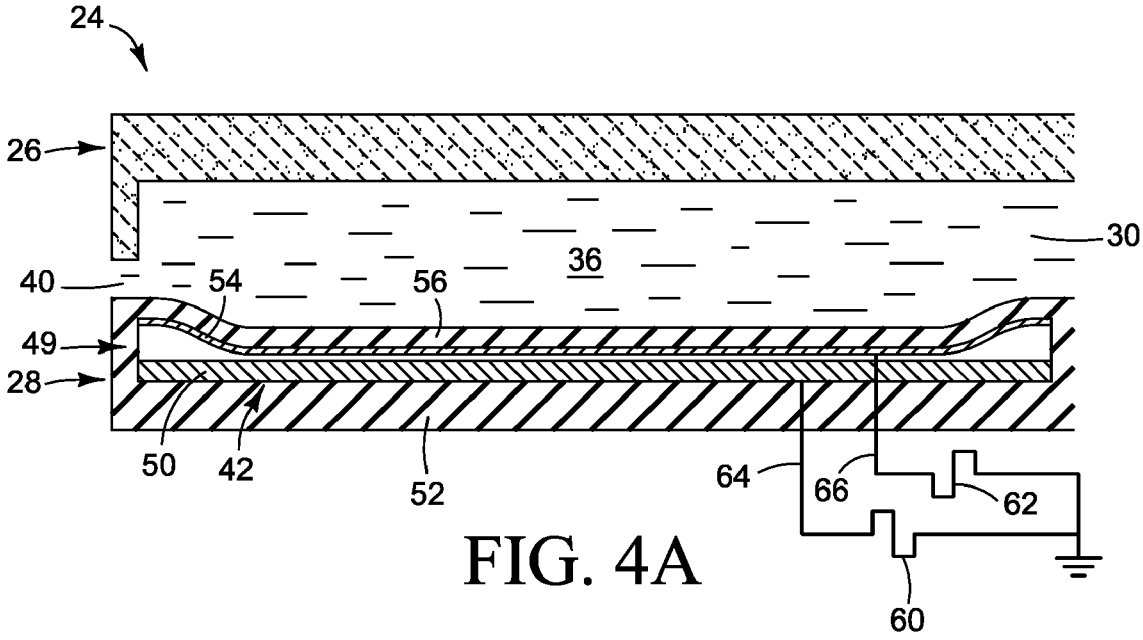
Figure 4B:
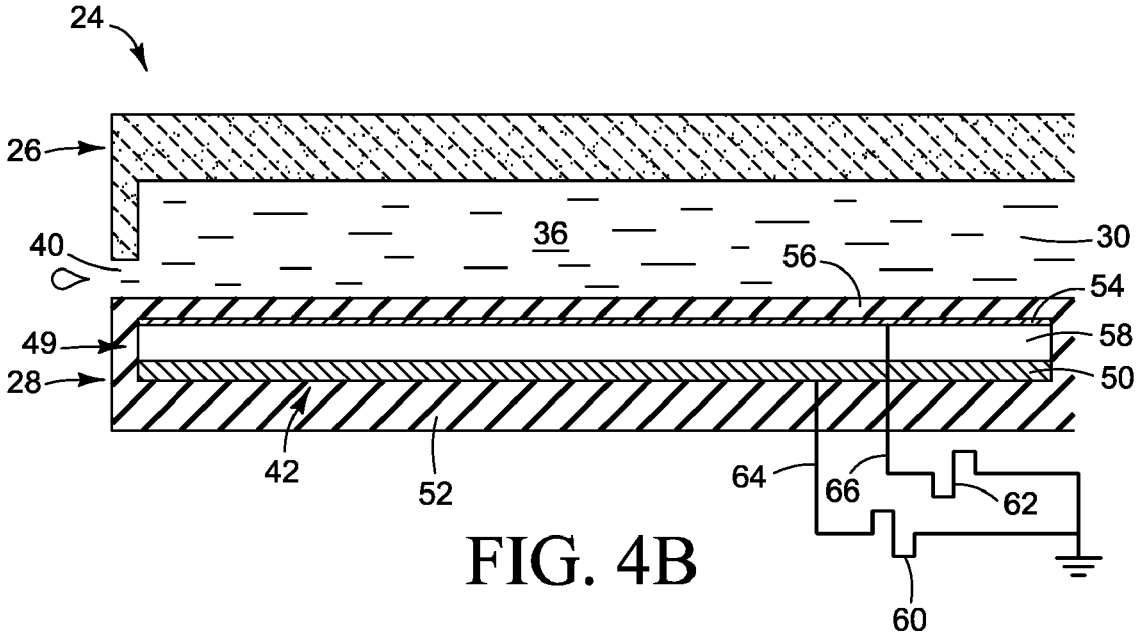

FIGS. 4A and 4B are simplified views representing a lengthwise section along an ink ejection chamber in one of the ink channels in the embodiment of the printhead shown in FIGS. 2 and 3. FIGS. 4A and 4B illustrate one embodiment of an electrostatic actuator that utilizes a single control conductor for each ink channel. FIG. 4A shows the actuator in the flexed position in which the ink channel is expanded. FIG. 4B shows the actuator in the unflexed position in which the ink channel is contracted.

Figure 5:
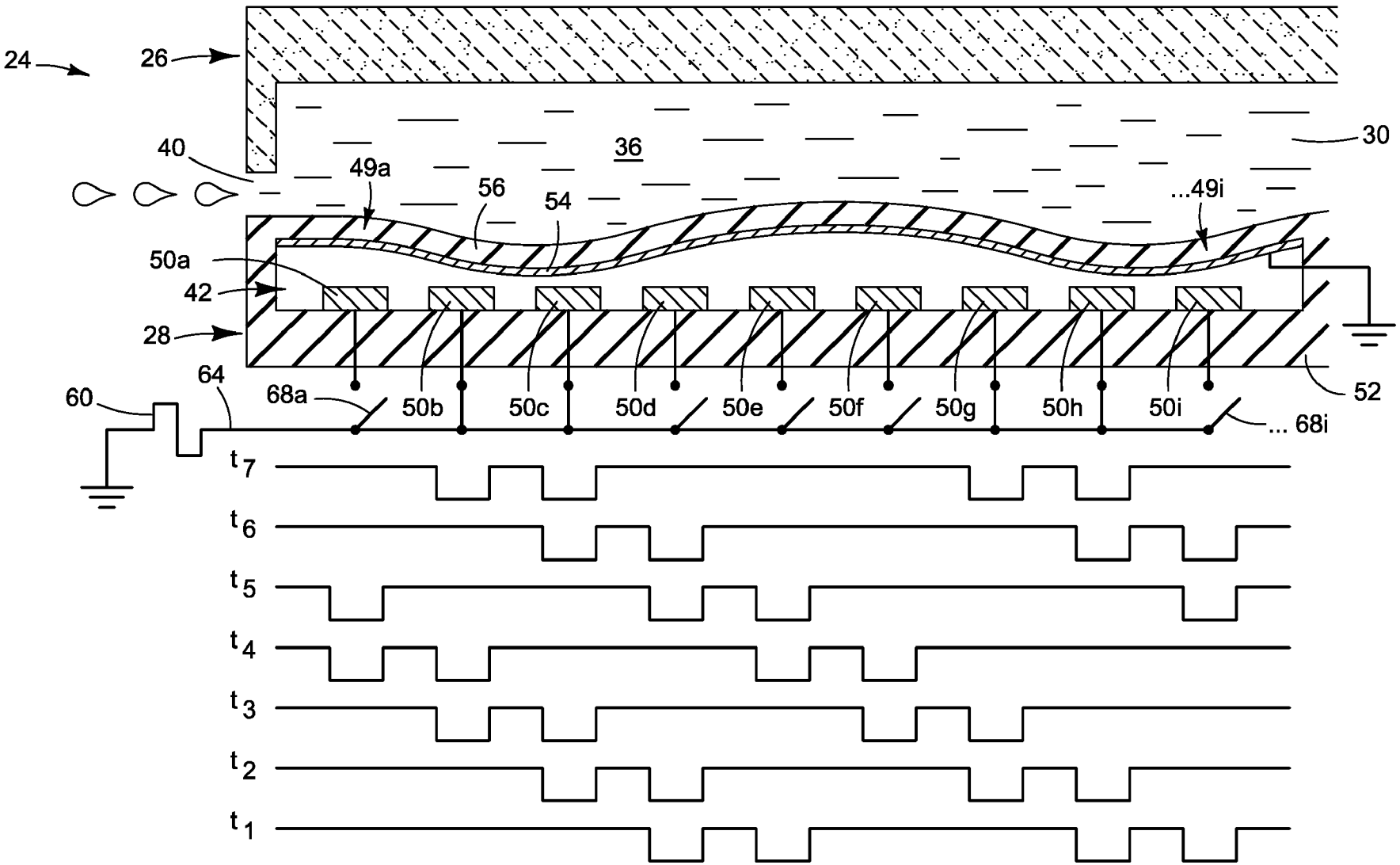

FIG. 5 is a simplified view representing a lengthwise section along an ink ejection chamber in one of the ink channels in the embodiment of the printhead shown in FIGS. 2 and 3. FIG. 5 illustrates another embodiment of an electrostatic actuator that utilizes multiple control conductors for each ink channel.

FIGS. 6-13 are crosswise section views taken along the line 13-13 in FIG. 3 illustrating one embodiment of a process for fabricating the printhead shown in FIGS. 2 and 3.

Figure 14:
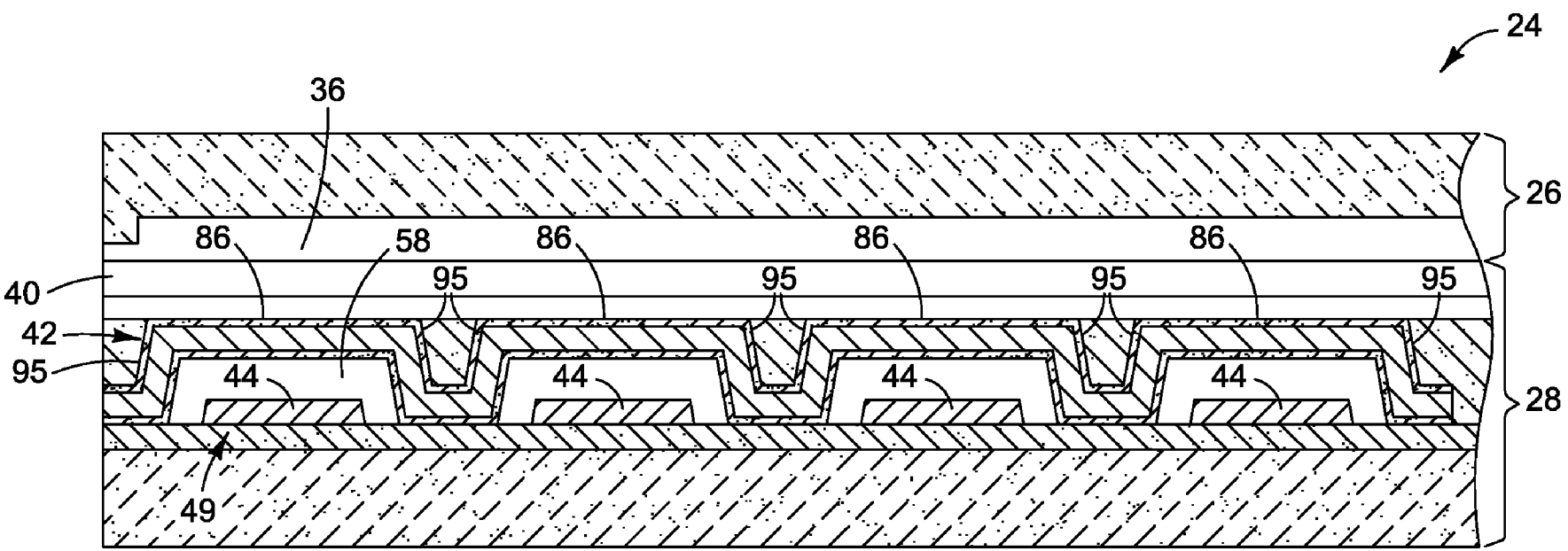

FIG. 14 is an embodiment of a lengthwise section view taken along the line 14-14 in FIG. 3.

Figure 1:
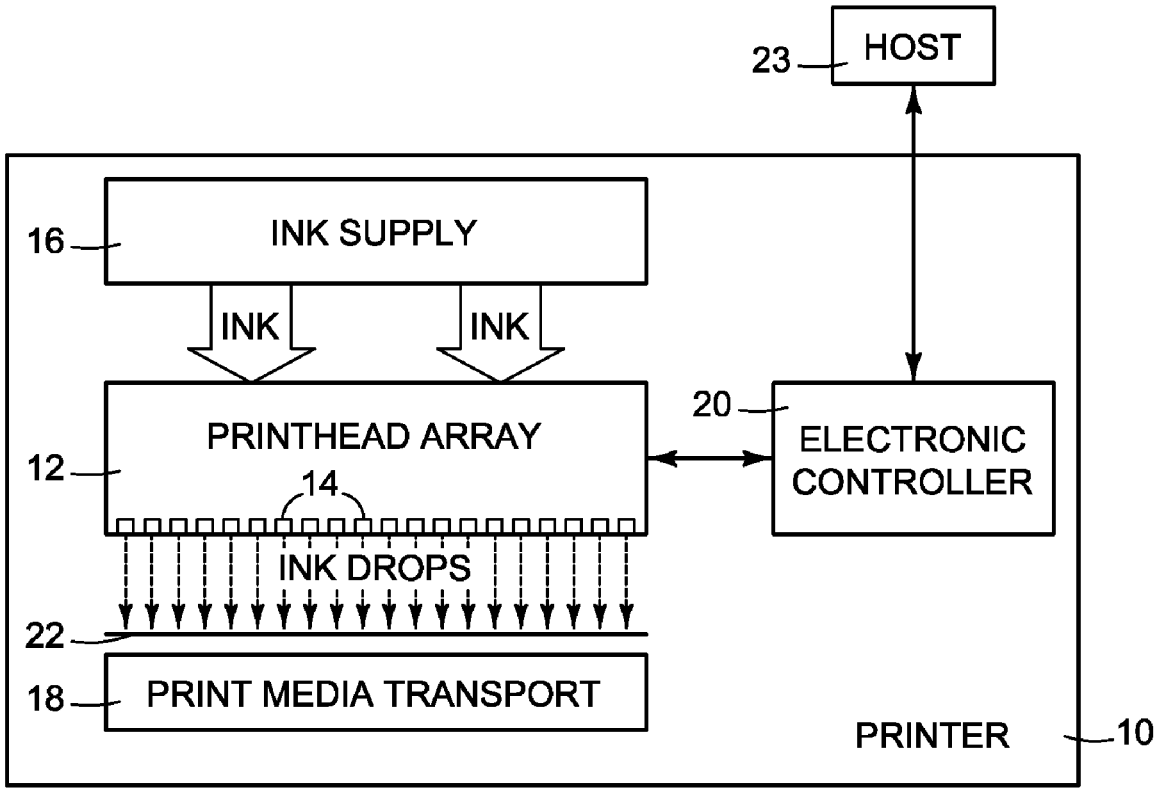
FIG. 1 is a block diagram illustrating an embodiment of an inkjet printer.
Figure 15:
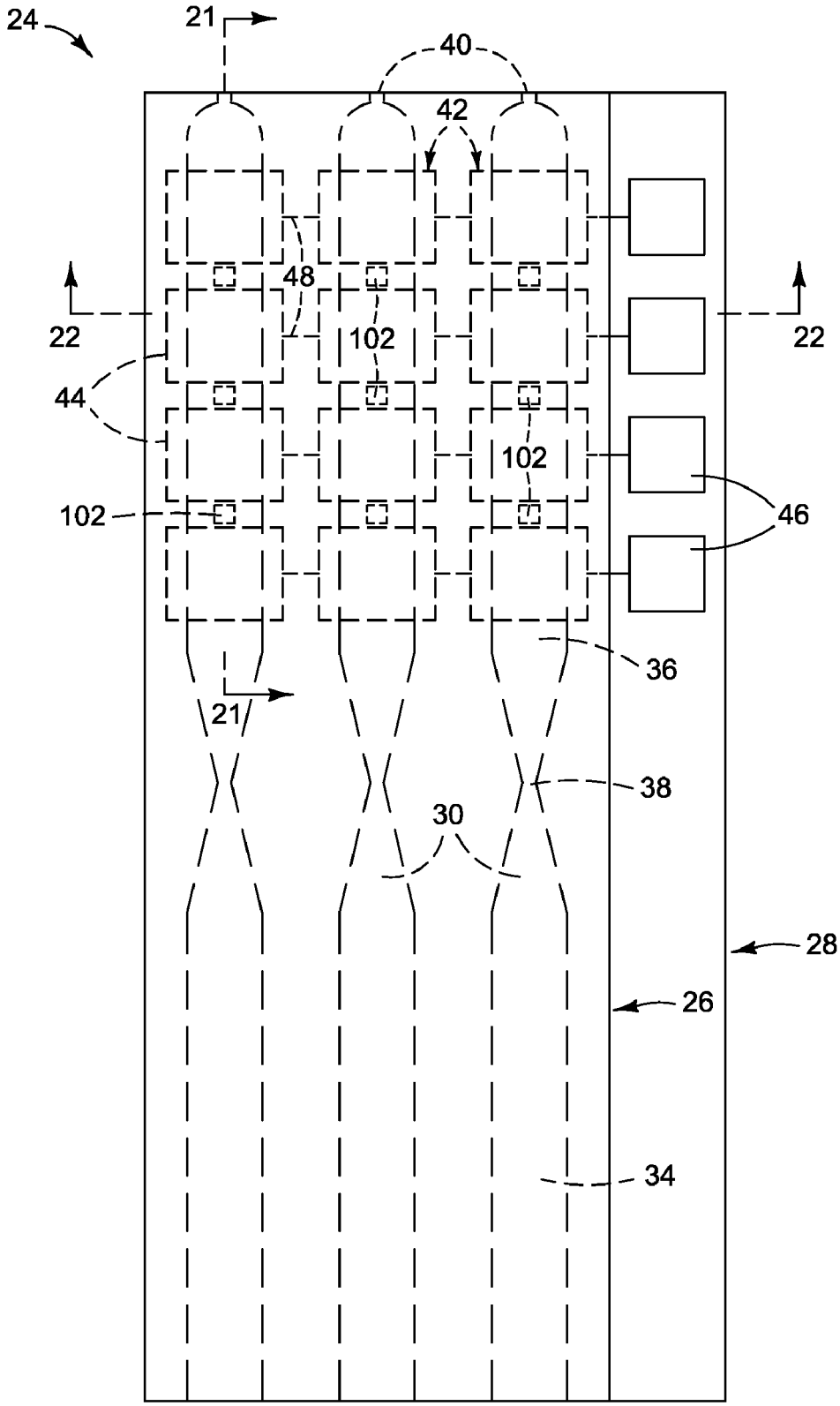

FIG. 15 is a plan view of one embodiment of an inkjet printhead that may be used in the printhead array in the printer shown in FIG. 1.

FIGS. 16-21 are lengthwise section views taken along the line 21-21 in FIG. 15 illustrating one embodiment of a process for fabricating the printhead shown in FIG. 15.

Figure 22:
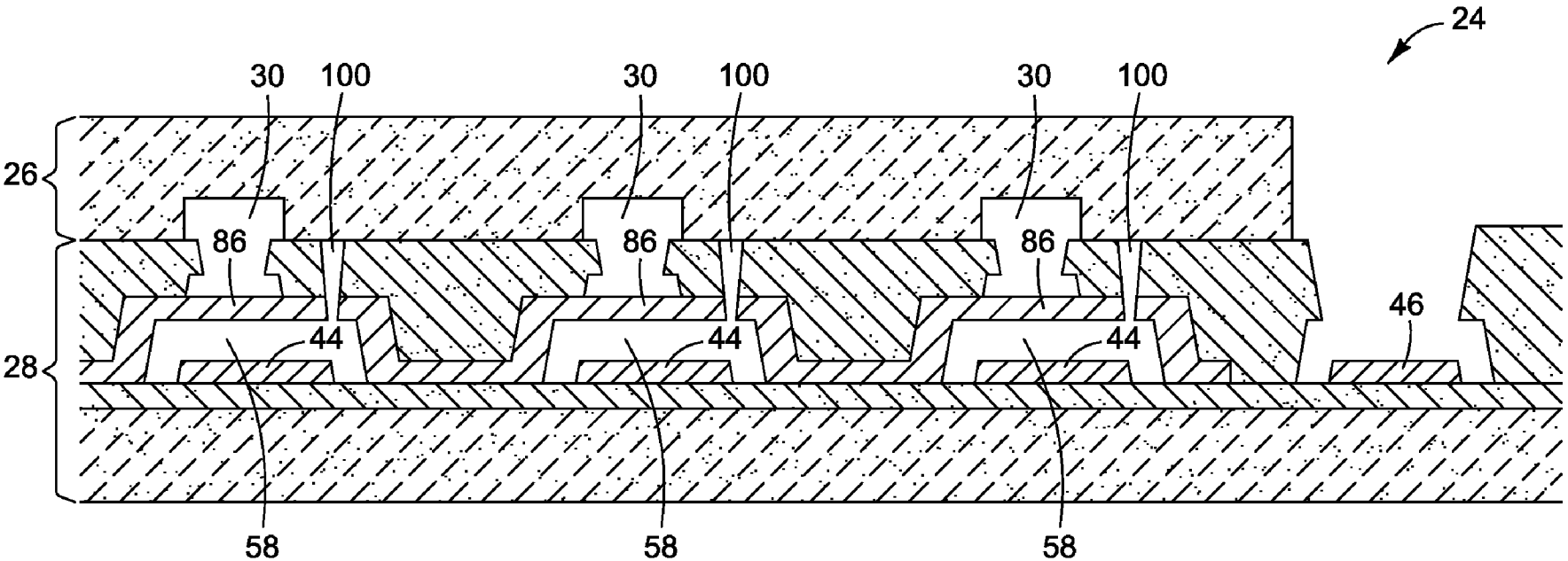

FIG. 22 is an embodiment of a crosswise section view taken along the line 22-22 in FIG. 15.

DESCRIPTION

Embodiments of the new electrostatic actuator and fabrication process were developed in an effort to produce an inkjet printhead actuator suitable for very large format inkjet printing applications using standard semiconductor wafer processing tools and techniques. Some embodiments of the new actuator, therefore, will be described with reference to inkjet printing. Embodiments of the present disclosure, however, are not limited to inkjet printing. Other forms, details, and embodiments may be made and implemented. Hence, the following description should not be construed to limit the scope of the present disclosure, which is defined in the claims that follow the description.

FIG. 1 is a block diagram illustrating an inkjet printer 10 that includes an array 12 of printheads 14, an ink supply 16, a print media transport mechanism 18 and an electronic printer controller 20. Printhead array 12 in FIG. 1 represents generally multiple printheads 14 and the associated mechanical and electrical components for ejecting drops of ink on to a sheet or strip of print media 22. An electrostatic inkjet printhead 14 may include one of more ink ejection orifices each associated with a corresponding ink channel. Electrostatic forces generated by conductors in the printhead flex one wall of the ink channel back and forth rapidly to alternately expand and contract the ink channel to eject drops of ink through the corresponding orifice. (Ink ejection orifices are also commonly referred to as ink ejection nozzles.) In operation, printer controller 20 selectively energizes the conductors in a printhead, or group of printheads, in the appropriate sequence to eject ink on to media 22 in a pattern corresponding to the desired printed image.

Printhead array 12 and ink supply 16 may be housed together as a single unit or they may comprise separate units. Printhead array 12 may be a stationary larger unit (with or without supply 16) spanning the width of print media 22. Alternatively, printhead array 12 may be a smaller unit that is scanned back and forth across the width of media 22 on a moveable carriage. Media transport 18 advances print media 22 lengthwise past printhead array 12. For a stationary printhead array 12, media transport 18 may advance media 22 continuously past the array 12. For a scanning printhead array 12, media transport 18 may advance media 22 incrementally past the array 12, stopping as each swath is printed and then advancing media 22 for printing the next swath. Controller 20 may receive print data from a computer or other host device 23 and, when necessary, process that data into printer control information and image data. Controller 20 controls the movement of the carriage, if any, and media transport 18. As noted above, controller 20 is electrically connected to printhead array 12 to energize the conductors to eject ink drops on to media 22. By coordinating the relative position of array 12 and media 22 with the ejection of ink drops, controller 20 produces the desired image on media 22 according to the print data received from host device 23.

FIGS. 2-3 are perspective and plan views, respectively, illustrating one example embodiment of a printhead 24 such as might be used as a printhead 14 in array 12 of the printer 10 shown in FIG. 1. The printhead array in a large format inkjet printer may contain hundreds or thousands of individual printheads 24. Referring to FIGS. 2 and 3, printhead 24 is an assembly composed of an ink channel structure 26 affixed to an actuator die 28. Ink channel structure 26 and actuator die 28 are fabricated separately and then bonded together or otherwise affixed to one another to form printhead 24. In the embodiment shown, three ink channels 30 are formed in structure 26. Ink channels 30 are recessed into or otherwise exposed along a surface 32 of structure 26. Each ink channel 30 includes a rear fill chamber 34 joined to a front ejection chamber 36 by a narrow part 38 that defines a transition between the two chambers 34 and 36. An ink ejection orifice 40 (also called a nozzle) is located at the forward end of each ejection chamber 36, as shown in FIG. 3. In the embodiments described in detail below, a portion of the ejection chamber 36 of each ink channel 30 is also formed in the actuator die 28. Although it is expected that ink channel structure 26 will typically be formed in a silicon substrate using conventional silicon wafer processing techniques (e.g., photolithographic patterning, etching and die cutting), other fabrication materials and techniques may be used. For example, structure 26 may be formed from plastics molded or machined into the desired structural configuration as long as the plastic may be securely affixed to actuator die 28.

Actuator die 28 includes an electrostatic actuator 42 adjacent to each ink ejection chamber 36. Each actuator 42 includes control conductors 44 (FIG. 3), electrical contact pads 46 and signal traces/wiring 48. These and other components of actuator 42 are described in detail below. Ink entering each channel 30 at fill chamber 34 passes through narrows 38 into ejection chamber 36, from which it is ejected through orifice 40 at the urging of the corresponding actuator 42. Other configurations for ink channel structure 26 and actuator die 28 are possible. The number and shape of the ink channels 30 in printhead 24 and the corresponding actuators 42, for example, may vary from that shown depending on performance criteria for the individual printheads, the characteristics of the printhead array and the printer, as well as fabrication tooling and processing techniques.

FIGS. 4A and 4B are simplified section views along an ejection chamber 36 showing the operative components of an actuator die 28. To better illustrate the operative features of each actuator 42, some of the structural features of die 28 and actuator 42 have been omitted from FIGS. 4A and 4B. FIG. 4A shows actuator 42 in a flexed position in which ink ejection chamber 36 is expanded. FIG. 4B shows actuator 42 in a flexed position in which ink ejection chamber 36 is contracted to eject an ink drop. Actuator 42 uses a MEMS (microelectromechanical system) capacitor 49 that is integrated into actuator die 28. One conductor on capacitor 49 is attached to the flexible membrane/wall of ink channel 30 and the other/opposite conductor is attached to or part of a rigid substrate. A varying voltage signal applied across the conductors alternately pulls the membrane toward the conductor substrate and releases the membrane to flex back into the original position to pump ink out through orifice 40.

Referring to FIGS. 4A and 4B, capacitor 49 in actuator 42 includes a first, non-flexing conductor 50 along actuator die substrate 52 and a second, flexing conductor 54 operatively connected to a flexible wall 56 of ink channel ejection chamber 36. Flexible wall 56 is sometimes referred to as a membrane or a vibration plate. Conductor 54 "operatively connected" to wall 56 means that conductor 54 is affixed to or otherwise constrained so that a deformation in conductor 54 creates a corresponding deformation in wall 56. Conductors 50 and 54 extend along ink channel ejection chamber 36 opposite one another across a gap 58. Non-flexing conductor 50 may itself be flexible or inflexible. If conductor 50 is flexible, then it will be affixed to substrate 52 or another suitable support to achieve the desired rigidity. The extent of flexible wall 56 and/or the extent to which conductor 54 covers wall 56 may vary depending on other characteristics of chamber 36. However, it is expected that flexible wall 56 will usually extend substantially the full length and span substantially the full width of ejection chamber 36, and conductor 54 will usually cover substantially all of the flexible portion of wall 56.

Each conductor 50 and 54 is connected to a signal generator or other suitable voltage source 60 and 62, as indicated by signal lines 64 and 66. Generating a voltage difference between the two conductors 50 and 54 across gap 58 creates electrostatic forces that can be used to flex conductor 54, and correspondingly wall 56, back and forth to alternately expand and contract ejection chamber 36. Varying the voltage difference in a desired pattern controls the ejection of ink drops through orifice 40. Any suitable drive circuitry and control system may be used to create the desired forces. The drive circuitry shown in which varying voltages may be applied to each conductor 50 and 54 through a separate signal generator 60 and 62 is just one example configuration. Other configurations are possible. For example, one of the conductors 50 or 54 may be held at a ground voltage (typically flexing conductor 54) and varying voltages applied to the other "control" conductor 50 or 54 (typically non-flexing conductor 50) to achieve the desired forces. Hence, conductors "operatively connected" to a voltage source as used in this document means connected in such a way that a voltage difference may be generated between the conductors, specifically including but not limited to the connections described above.

FIG. 5 is a simplified view representing a section along ejection chamber 36 showing the operative components of another embodiment of an electrostatic actuator 42. In the embodiment shown in FIG. 5, multiple control, non-flexing conductors 50*a*-50*i* are used in capacitors 49*a*-49*i* to generate a wave in flexible wall 56 of ink ejection chamber 36. (Only part numbers 49*a* and 49*i* are referenced on FIG. 5.) In the embodiment shown in FIG. 5, ink drops are ejected through orifice 40 from a continuous pulsing wave, rather than from a series of discrete incremental pulses as in the single conductor embodiment shown in FIGS. 4A and 4B. The resulting peristaltic pumping may be used to control the meniscus at orifice 40 and help reduce (1) ingesting air bubbles through orifice 40 and/or (2) drooling ink or other fluid out of orifice 40. As used in this document, peristaltic pumping means moving fluid by waves of contraction and/or expansion. One example voltage/signal pulse progression is illustrated by the time lines $t_1$-$t_7$ in FIG. 5. In this example progression, flexing conductor 54 is held at a ground voltage while a signal generator 60 simultaneously pulses four conductors through, for example, a series of gates or switches 68*a*-68*i*, in a predetermined pattern and the pulse pattern shifts by one conductor with each increment of time. At time $t_1$, pulses are applied to conductors 50*d*/50*e* and 50*h*/50*i*; at time $t_2$, pulses are applied to conductors 50*c*/50*d* and 50*g*/50*h*; and so on. The state of switches 68*a*-68*i* shown in FIG. 5 corresponds to the pulse pattern shown at time $t_7$. The pulse pattern and progression may be set and/or varied as desired to achieve the proper flow of ink drops through orifice 40.

One embodiment of the structure of actuator die 28 and one example process for fabricating die 28 and printhead 24 will now be described with reference to FIGS. 6-14. FIG. 13 is a crosswise section illustrating a view taken along the line 13-13 in FIG. 3 showing printhead 24. FIG. 14 is a lengthwise section illustrating a view taken along the line 14-14 in FIG. 3 showing printhead 24. FIGS. 6-12 are crosswise section views showing process steps in the fabrication of actuator die 28 and printhead 24. The structures shown in FIGS. 6-14 are not to scale nor do they correlate exactly to the corresponding structures shown in FIG. 3. Rather, the structures shown in FIGS. 6-14 are presented in an illustrative manner to help show pertinent structural and processing features of this embodiment of the present disclosure.

Figure 6:
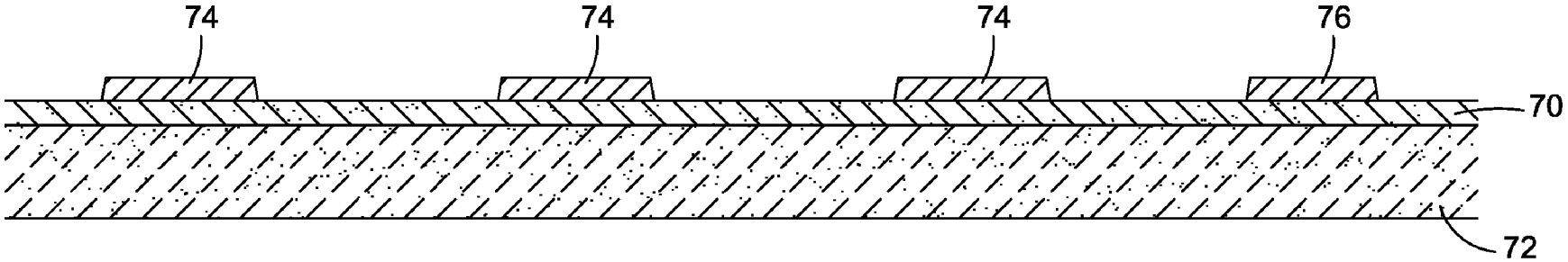

Referring first to FIG. 6, a thin oxide layer 70 is formed on a silicon substrate 72 by, for example, thermally oxidizing the surface of substrate 72 to form a layer of silicon dioxide. An oxide layer 70 works well as a hard mask for the subsequent spacer etch and it provides a good bonding surface. Hence, while it is expected that an oxide layer will be used many applications, other configurations are possible. For example, an unoxidized silicon substrate 72 may provide an acceptable bonding surface in which case a photoresist may be used for the spacer etch. In addition, although the formation of the components of a single actuator die are shown, the components of many such dies may be formed simultaneously on a silicon wafer (substrate 72) and the individual dies subsequently cut or otherwise singulated from the wafer. Also, while the present disclosure will be described in terms of Metal Oxide Semiconductor (MOS) technology, which remains one of the most commonly used integrated circuit technologies, other suitable technologies may be used. A layer of tantalum aluminum (TaAl) or another suitable conductive material is deposited or otherwise formed on thin oxide 70. The conductive layer is selectively removed to form control conductors 74 and contact pads 76 (conductors 44 and contact pads 46 in FIG. 3) by, for example, patterning and etching the conductive layer.

The formation of integrated circuits often includes photolithographic masking and etching. This process consists of creating a photolithographic mask containing the pattern of the component to be formed, coating the wafer with a light-sensitive material called photoresist, exposing the photoresist coated wafer to ultra-violet light through the mask to soften or harden parts of the photoresist, depending on whether positive or negative photoresist is used, removing the softened parts of the photoresist, etching to remove the materials left unprotected by the photoresist and stripping the remaining photoresist. This photolithographic masking and etching process is referred to herein as "patterning and etching." Although it is expected that the selective removal of materials will typically be achieved by patterning and etching, other selective removal processes could be used. Hence, the reference to patterning and etching in the example fabrication process described and shown should not be construed to limit the processes that may be used for the selective removal of material in the claims that follow this description.

Figure 7:
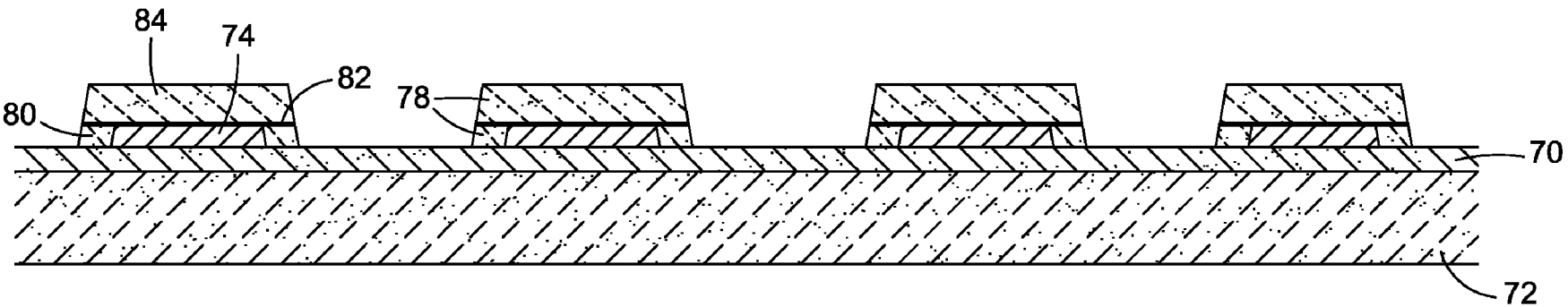

Referring to FIG. 7, sacrificial spacers 78 are formed over conductors 74. Spacers 78 are removed later to define the electrostatic gaps between the flexing and non-flexing printhead conductors (i.e., between the capacitor conductors). Each spacer 78 may be constructed as a single body of amorphous silicon, or other suitable material, deposited on the underlying structure and then patterned and etched into the desired shape. Alternatively, spacers 78 may be constructed as a composite of more than one layer of material. For example, spacers 78 may be formed by first depositing a layer of amorphous silicon on the underlying structure to approximately the thickness of conductors 74. This first silicon layer is planarized to conductors 74, by chemical-mechanical polishing for example. The planarization may extend to conductors 74 as necessary or desirable to help ensure a flat surface for further processing and for a uniform electrostatic gap. A thin layer of silicon nitride is then formed on the underlying structure and a thick layer of amorphous silicon is deposited on the silicon nitride. The silicon/nitride/silicon stack is patterned and etched to form spacers 78, each including a thin layer of silicon nitride 82 sandwiched between silicon sidewalls 80 and silicon cap 84. While any suitable spacer material may be used, it is desirable to use materials that are selectively etchable with respect to conductors 74 and oxide 70 to help control the spacer release etch described below.

Figure 8:
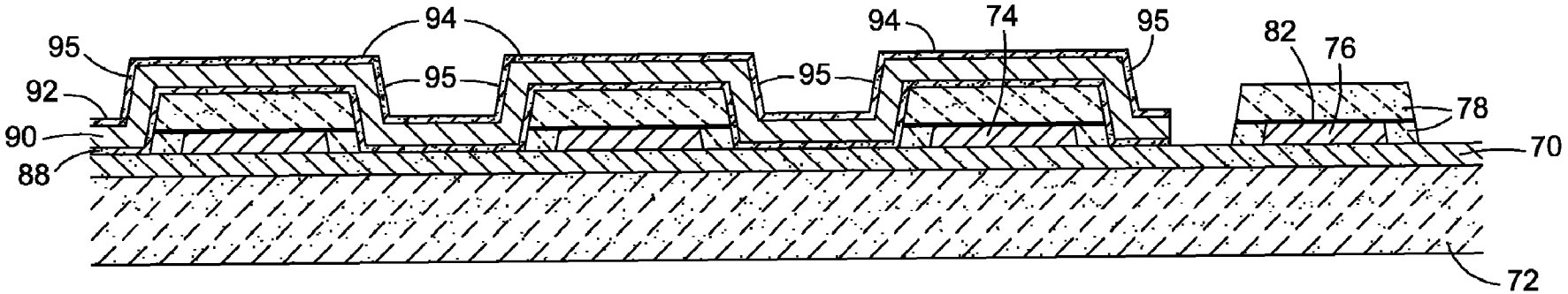

In the embodiment shown, and referring now to FIG. 8, the flexible parts 86 (FIGS. 12-14) of the wall along each ink channel are constructed as a conducting layer 90 sandwiched between insulating layers 88 and 92. Flexible wall part 86 is also sometimes referred to in this document as a membrane 86. A thin insulating layer 88 is formed on the underlying structure, a tantalum aluminum (TaAl) layer 90 or another suitable conductor is deposited on insulating layer 88, and a second thin insulating layer 92 is formed on conductive layer 90. Although it is expected that insulating layers 88 and 92 will often be formed by depositing silicon dioxide using a tetraethylorthosilicate low temperature chemical vapor deposition (TEOS) process, other suitable materials and processes could also be used. The insulated conductor stack 94 is patterned and etched to form membrane 86 and to expose contact pads 76. Unlike some conventional electrostatic printheads, in which part of the sacrificial spacer is left to partition the control conductors, stack 94 is used to separate the control conductors 74 from one another in both the crosswise direction (FIGS. 8-13) and in the lengthwise direction (FIG. 14), thus allowing for the complete removal of spacer 78 in the release etch. That portion of stack 94 that drops down to the substrate (at oxide layer 70) between control conductors 74, designated by part number 95, also supports membrane 86 (the horizontal, flexible parts of stack 94) after the release etch. This configuration for the membrane layer in printhead 24, therefore, has two significant advantages over conventional printheads. First, the membrane layer is self supporting and, second, it may be used to separate the control conductors.

Figure 9:
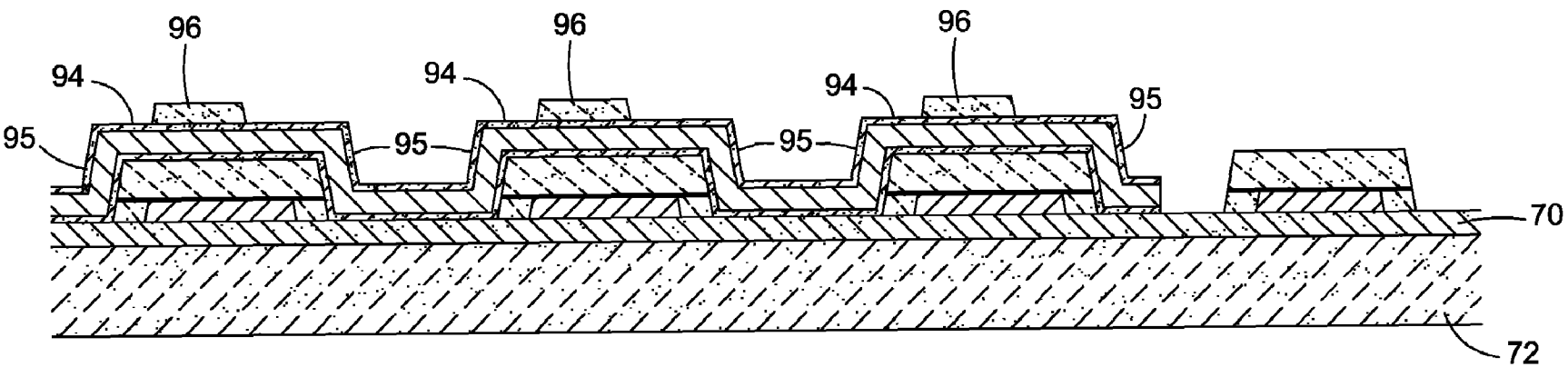

Referring to FIG. 9, second sacrificial spacers 96 are formed over insulated conductor stack 94. Spacers 96 are removed later to define the width of membrane 86. Each spacer 96 may be constructed as a single body of amorphous silicon, or other suitable material, deposited on the underlying structure and then patterned and etched into the desired shape. Again, while any suitable spacer material may be used, it is desirable to use a material that is selectively etchable with respect to oxide layer 92 to help control the release etch.

Figure 10:
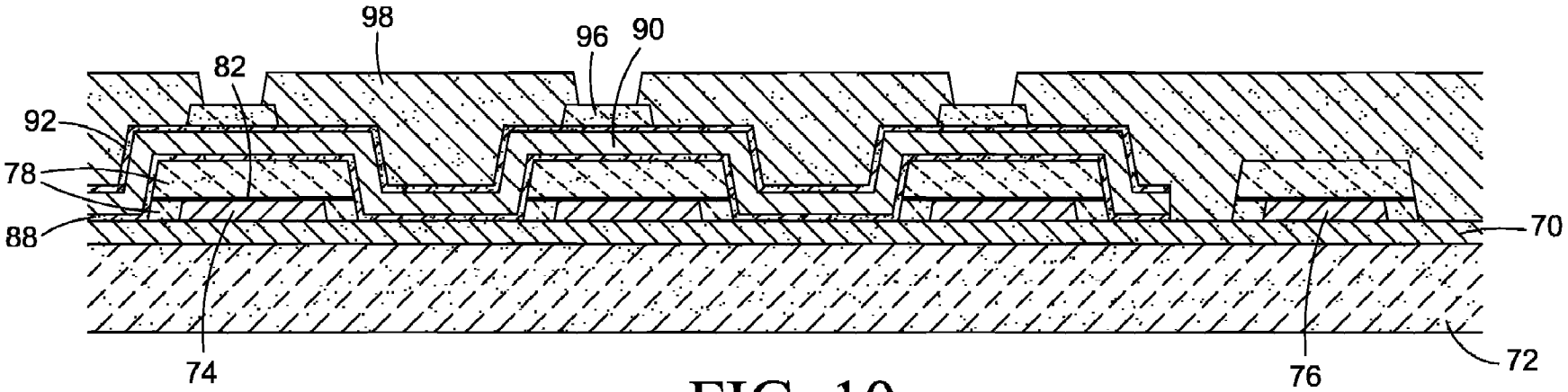
Figure 11:
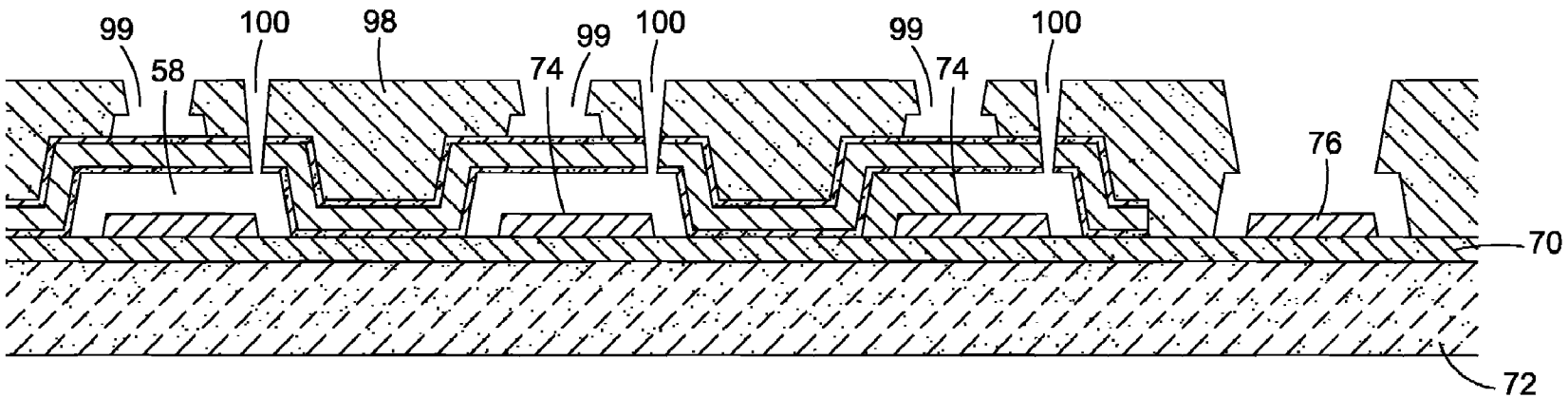

Referring to FIG. 10, a thick TEOS oxide or other suitable insulating layer 98 is formed over the underlying structure. Insulating layer 98 is planarized by, for example, chemical-mechanical polishing to provide a flat, smooth surface for bonding the actuator die 28 to ink channel structure 26. Insulating layer 98 is patterned and etched to expose sacrificial spacers 96 and partially form the extension 99 (FIG. 11) of the ink channels into actuator die 28. This etch may continue, as shown in FIG. 11, to expose contact pads 76 and to open a hole 100 to expose sacrificial spacers 78 and to fully form ink channel extensions 99. Alternatively, a second masking/patterning and etching step may be used to expose contact pads 76 and to open a hole 100 to expose sacrificial spacers 78. A so-called "release" etch is then performed to remove spacers 96 and 78, forming the structure shown in FIG. 11. TEOS layers 92 and 98, oxide layer 88 and metal control conductors 74 serve as etch stops while etching silicon spacers 78 and 96 to help allow for the complete removal of spacers 78 and 96 without also degrading surrounding structures. That is to say, the release etch is selective to remove the amorphous silicon spacer material but not the oxides and metals. Hence, the timing of the release etch is not substantially significant to defining either the electrostatic gap 58 formed by the removal of spacers 78 or the actuator width defined by the removal of spacers 96.

Insulating layer 88, which faces control conductors 74, provides electrical insulation between conductors 74 and 90 and helps prevent shorting between the conductors. Insulating layer 92, which faces ink channel 30, insulates conductor 90 against chemical attack by the ink. However, depending on the selection of a variety of design factors in printhead 24, specifically including the electostatic displacement of conductive membrane 86, the size of gap 58, and the use of stiction bumps or other short preventing structures, insulating layer 88 may be omitted. Similarly, if conductive layer 90 is not susceptible to chemical degradation from the inks that may be used in printhead 24, then insulating layer 92 may be omitted. Hence, it may be possible to form membrane 86 from an uninsulated conductive layer 90 which is ink resistant and otherwise configured to not short to control conductors 74.

Figure 12:
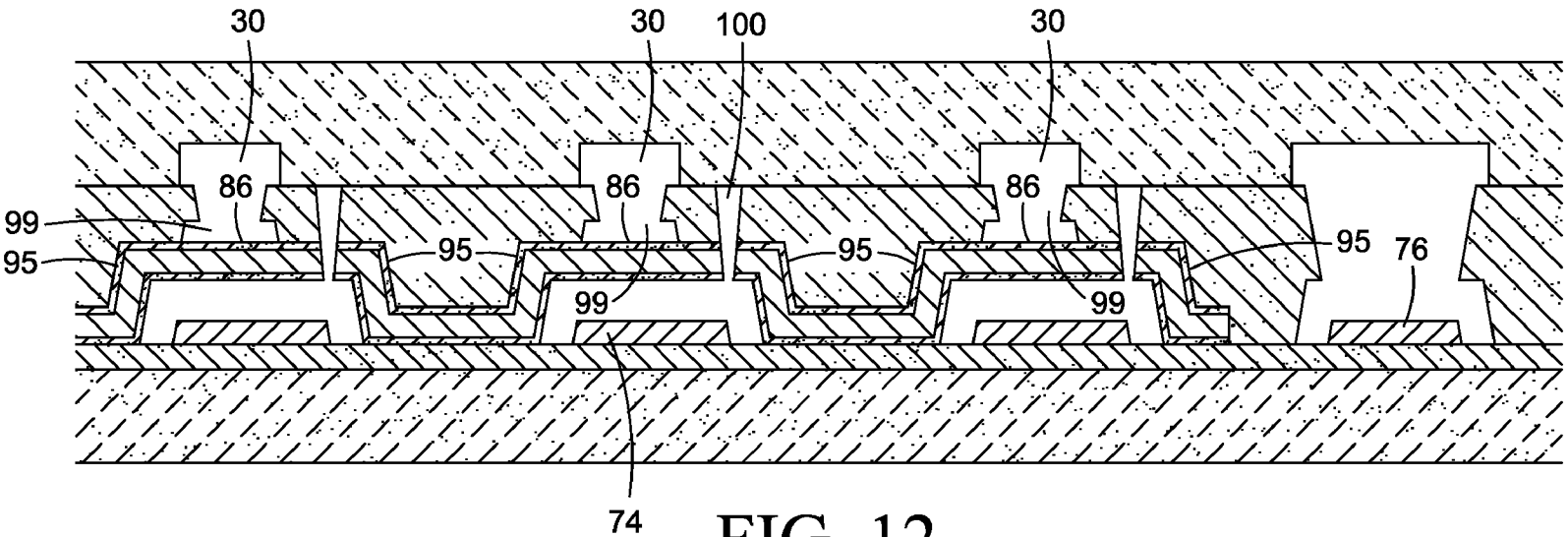
Figure 13:
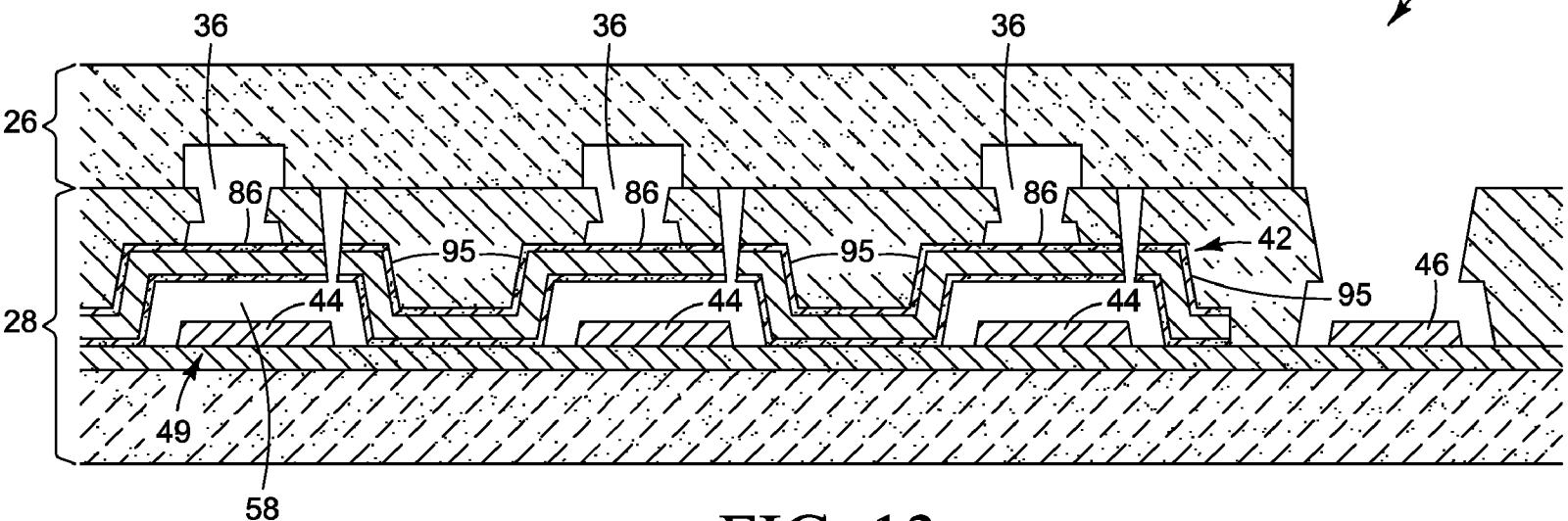

Ink channel structure 26 is bonded to the completed actuator die 28 by plasma bonding or another suitable bonding process, as shown in FIG. 12, to mate each ink channel 30 with the corresponding membrane 86 and to cover clear hole 100. That portion of ink channel structure 26 over contact pads 76 (pads 46 in FIGS. 2 and 3) is then removed by, for example, saw cutting to expose pads 76.

The completed printhead 24 is shown in FIGS. 13 and 14. (FIG. 14 is a lengthwise section view taken along the line 14-14 in FIG. 3.) Capacitors 49, typical at each location of conductor 44, are specifically designated by part number only once in each of FIGS. 13 and 14. The particular dimensions of the various layers and components described above can vary widely depending on the printing application. Nevertheless, for an electrostatic inkjet printhead 24 used in an array 12 (FIG. 1) in a very large format printing application in which the array includes hundreds of printheads, the following is one example of the nominal sizes of some of the components in a printhead 24 printing at a resolution of 600 dpi (dots per inch). Each ink channel 30 and corresponding membrane 86 is about 30 micrometers wide. The electrostatic gap 58 and membrane 86 are each about 200 nanometers thick (conductor 90 is about 100 nanometers thick and each TEOS oxide layer is about 50 nanometers thick). Ejection chamber 36 in each ink channel 30 is about 100 micrometers deep (including parts formed in both structure 26 and die 28).

Another embodiment of the structure of actuator die 28 and another example process for fabricating die 28 and printhead 24 will now be described with reference to FIGS. 15-22. FIG. 21 is a lengthwise section illustrating a view taken along the line 21-21 in FIG. 15 showing printhead 24. FIG. 22 is a crosswise section illustrating a view taken along the line 22-22 in FIG. 15 showing printhead 24. FIGS. 16-20 are lengthwise section views showing process steps in the fabrication of actuator die 28 and printhead 24. As described in detail below, in this embodiment, stiction bumps are formed between control electrodes and the membrane layer drops down to the substrate between control electrodes in the crosswise direction only. The structures shown in FIGS. 16-22 are not to scale nor do they correlate exactly to the corresponding structures shown in FIG. 15. Rather, the structures shown in FIGS. 16-22 are presented in an illustrative manner to help show pertinent structural and processing features of this embodiment of the present disclosure.

Referring first to FIG. 15, so-called "stiction" bumps 102 are formed in actuator die 28 between control electrodes 44 along the length of each channel 30. Stiction bumps are used in MEMS devices to help reduce unwanted STicking and friCTION (hence, the name "stiction") and/or to provide a mechanical stand-off that keeps conductors physically separated to help prevent electrical shorting between the conductors. "Stiction bumps" as used in this document refers to bumps configured to perform either or both of these functions. The other components shown in FIG. 15 are the same as those shown and described above with reference to FIG. 3. Printhead 24 is an assembly composed of ink channel structure 26 affixed to actuator die 28. Ink channel structure 26 and actuator die 28 are fabricated separately and then bonded together or otherwise affixed to one another to form printhead 24. Each ink channel 30 includes a rear fill chamber 34 joined to a front ejection chamber 36 by a narrow part 38 that defines a transition between the two chambers 34 and 36. An ink ejection orifice 40 (also called a nozzle) is located at the forward end of each ejection chamber 36. Actuator die 28 includes an electrostatic actuator 42 adjacent to each ink ejection chamber 36. Each actuator 42 includes control conductors 44, electrical contact pads 46 and signal traces/wiring 48.

Figure 16:
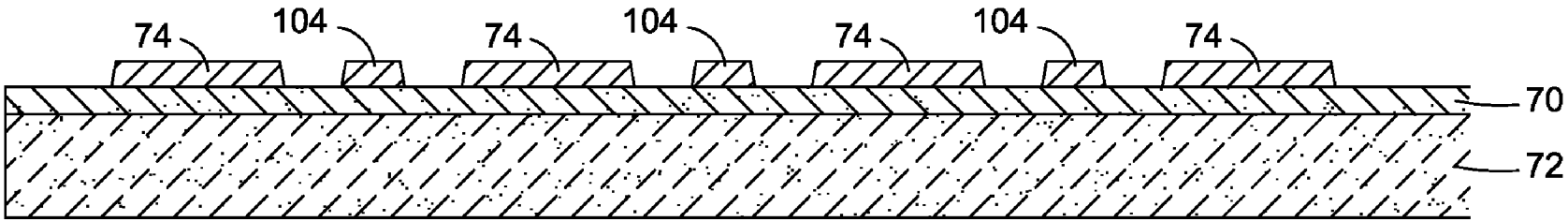

Referring now to FIG. 16, a thin oxide layer 70 is formed on a silicon substrate 72 by, for example, thermally oxidizing the surface of substrate 72 to form a layer of silicon dioxide. An oxide layer 70 works well as a hard mask for the subsequent spacer etch and it provides a good bonding surface. Hence, while it is expected that an oxide layer will be used many applications, other configurations are possible. For example, an unoxidized silicon substrate 72 may provide an acceptable bonding surface in which case a photoresist may be used for the spacer etch. A layer of tantalum aluminum (TaAl) or another suitable conductive material is deposited or otherwise formed on thin oxide 70. The conductive layer is selectively removed to form control conductors 74 (conductors 44 in FIG. 15) and stiction bump blockers 104 by, for example, patterning and etching the conductive layer. While it is expected that it may be convenient to form bump blockers 104 at the same time, and from the same material, as control conductors 74, blockers 104 might also be formed separately and from another material, including an insulating material.

Figure 17:
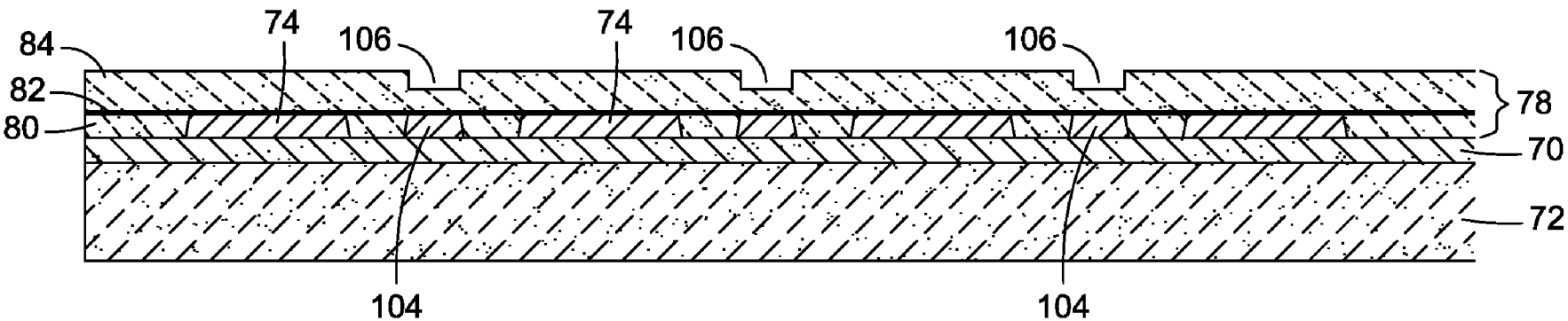

Referring to FIG. 17, a sacrificial spacer 78 is formed over conductors 74. Spacer 78 is removed later to define the electrostatic gaps between the flexing and non-flexing printhead conductors (i.e., between the capacitor conductors). In the embodiment shown, spacer 78 includes a thin layer of silicon nitride 82 sandwiched between silicon sidewalls 80 and silicon cap 84. While any suitable spacer material may be used, it is desirable to use materials that are selectively etchable with respect to conductors 74 and oxide 70 to help control the spacer release etch described below. A recess 106 is etched or otherwise formed in the upper surface of spacer 78 (silicon cap 84) at the desired location of stiction bumps 102 over each bump blocker 104.

Figure 18:
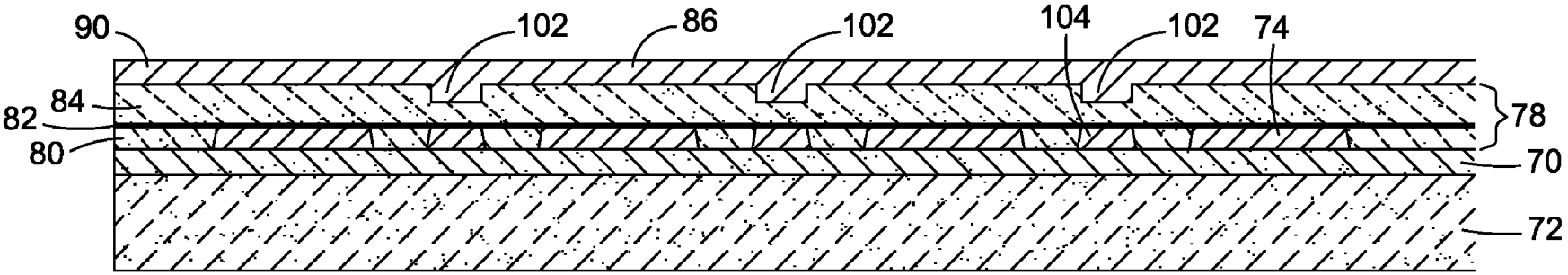

Referring to FIG. 18, in this embodiment, conductive membrane 86 is constructed from a single conducting layer 90. Conductive layer 90 is patterned and etched to form membrane 86 and to expose contact pads 46 (see FIG. 22). Conductive layer 90 filling each recess 106 forms stiction bumps 102. Also in this embodiment, conductor layer 90 separates the control conductors 44 from one another in only the crosswise direction as best seen by comparing FIGS. 21 and 22. That portion of conductor 90 that drops down to the substrate (at oxide layer 70) between control conductors 74/44 in FIG. 22 also supports membrane 86 (the horizontal, flexible parts of conductor 90) after the release etch.

Figure 19:
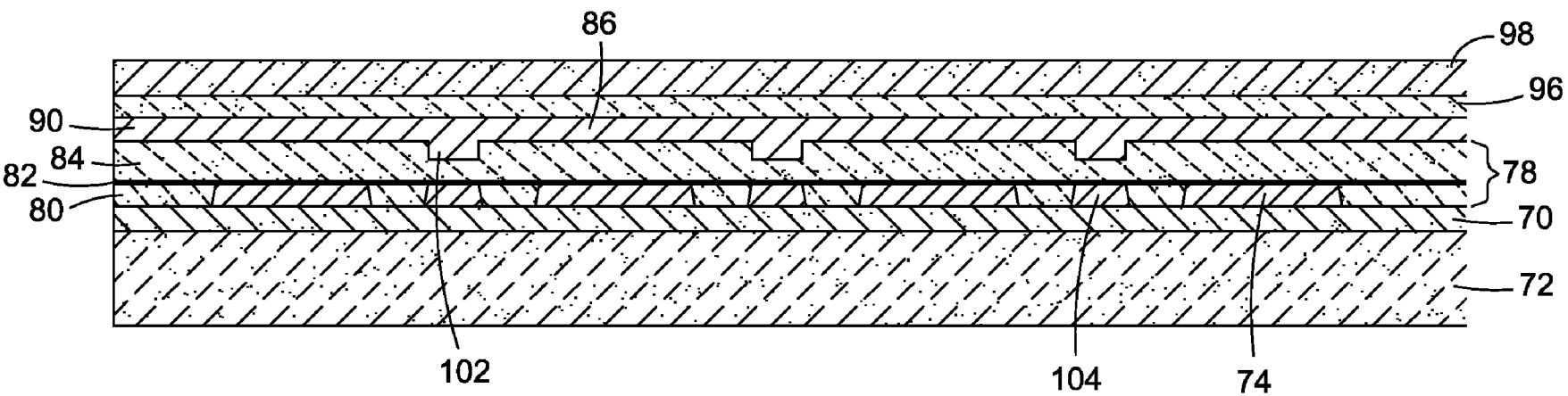

Referring to FIG. 19, a second sacrificial spacer 96 is formed over conductor 90. Spacer 96 is removed later to define the width of membrane 86 (see FIG. 22). Then, a thick TEOS oxide or other suitable insulating layer 98 is formed over the underlying structure. Insulating layer 98 is planarized by, for example, chemical-mechanical polishing to provide a flat, smooth surface for bonding the actuator die 28 to ink channel structure 26. Insulating layer 98 is patterned and etched to expose sacrificial spacer 96 and partially form the extension of the ink channels into actuator die 28, as described above with reference to FIGS. 10 and 11. This etch may continue, as shown in FIG. 22, to expose contact pads 46 and to open holes 100 to expose sacrificial spacer 78. Alternatively, a second masking/patterning and etching step may be used to expose contact pads 76 and to open clear holes 100.

Figure 20:
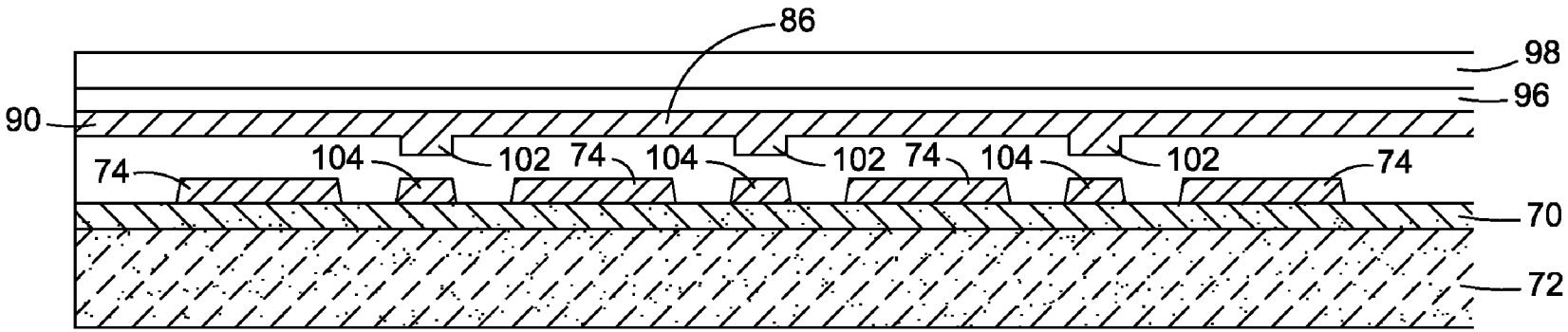
Figure 21:
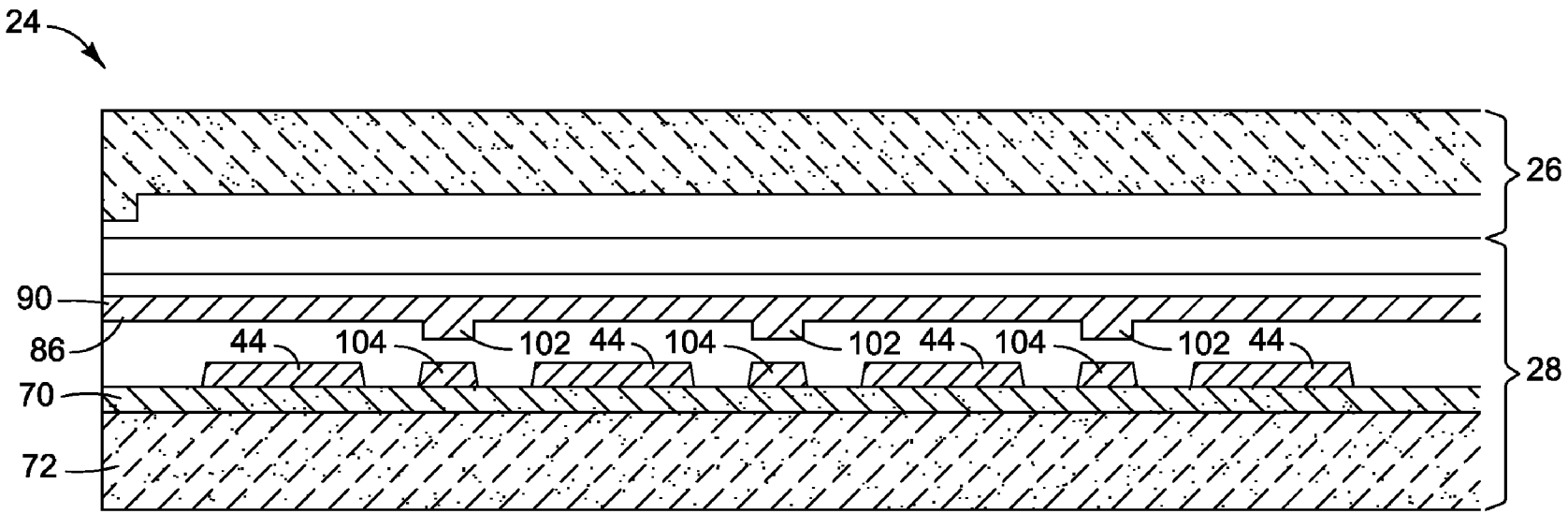

A release etch is then performed to remove spacers 96 and 78, forming the structure shown in FIG. 20. Ink channel structure 26 is bonded to the completed actuator die 28 by plasma bonding or another suitable bonding process, as shown in FIGS. 21 and 22 to mate each ink channel 30 with the corresponding membrane 86 and to cover clear holes 100. That portion of ink channel structure 26 over contact pads 76 (pads 46 in FIGS. 2-3 and 22) is then removed by, for example, saw cutting to expose pads 76. Referring to FIG. 21, stiction bumps 102 provide a mechanical stand-off that keeps conductive membrane 86 and control conductors 44 physically separated when membrane 86 flexes down toward conductors 44 to help prevent electrical shorting between conductors 86 and 44. Where bump blockers 104 are conductive, blockers 104 and bumps 102 are held at the same voltage so that conductors 102 and 104 also do short to one another.

In one embodiment, an inkjet printhead comprises:

a first structure having a plurality of first ink channels formed at a bonding surface of the first structure, the first ink channels arranged generally parallel to one another across the first structure bonding surface;

a second structure having a plurality of second ink channels formed at a bonding surface of the second structure, the second ink channels arranged generally parallel to one another across the second structure bonding surface, the first and second structures bonded to one another at their respective bonding surfaces such that each of the first ink channels is aligned with a corresponding one of the second ink channels to form a plurality of ink chambers, and the second structure including an electrostatic actuator that includes:

a first conductor having a plurality of flexible first parts supported by a plurality of second parts, each flexible first part defining at least part of one wall of each of the second ink channels; and a plurality of second conductors each aligned across a gap opposite a corresponding one of the first parts of the first conductor; and an orifice in each ink chamber through which fluid may be ejected from the chamber at the urging of the actuator.

In this inkjet printhead embodiment, a second conductor second part may be disposed between each pair of first conductors positioned adjacent to one another. In this inkjet printhead embodiment, the actuator may further include a voltage source operatively connected to each of the second conductors for selectively applying a voltage between each of the second conductors and the first conductor.

In one embodiment, an inkjet printer comprises:

an ink supply;

an array of printheads operatively connected to the ink supply, each printhead in the array including an electrostatic actuator for ejecting ink drops from a plurality of ink chambers in the printhead, the actuator comprising:

a plurality of first conductors each associated with one of the ink chambers;

an insulated second conductor having a plurality of flexible first parts and a plurality of second parts, each flexible first part forming at least part of a wall of the chamber and each flexible first part located opposite a corresponding one of the first conductors across a gap, and each second part separating one of the first conductors from another of the first conductors; and a voltage source operatively connected to each of the second conductors for selectively applying a voltage between each of the second conductors and the first conductor;

an electronic controller operatively connected to the printheads for selectively activating the electrostatic actuators in the printheads; and a print media transport mechanism configured to move print media past the printhead array at the urging of the controller.

In one embodiment, a method of forming an electrostatic actuator comprises:

forming a first layer of spacer material over the structure and over the first conductors;

selectively removing parts of the first layer of spacer material to form first spacers covering each of the first conductors and to expose the structure between the first spacers;

covering the first spacers and the exposed structure between the first spacers with an insulated second conductor;

forming a second layer of spacer material over the insulated second conductor;

selectively removing parts of the second layer of spacer material to form second spacers on the insulated second conductor directly over each of the first conductors;

covering the second spacers and the insulated conductor with an insulating material;

selectively removing parts of the insulating material to expose the second spacers along channels in the insulating material; and removing the first and second spacers.

In this method of forming embodiment, the structure may include a silicon structure and covering the first spacers and the exposed structure between the first spacers with a second conductor may include covering the first spacers and the exposed structure between the first spacers with an insulated second conductor.

As noted at the beginning of this Description, the example embodiments shown in the figures and described above illustrate but do not limit the claimed subject matter. Other forms, details, and embodiments may be made and implemented. Therefore, the foregoing description should not be construed to limit the scope of the claimed subject matter, which is defined in the following claims.

What is claimed is:

1. An electrostatic actuator for ejecting fluid from a plurality of chambers, comprising:

a first conductor associated with each chamber;

a second conductor having a plurality of flexible first parts supported by a plurality of second parts, each flexible first part forming at least part of a wall of each chamber and each flexible first part located opposite a corresponding one of the first conductors across a gap; and a voltage source operatively connected to each of the first conductors for selectively applying a voltage between each of the first conductors and the second conductor.

2. The actuator of claim 1, wherein the second conductor comprises an insulated second conductor having a layer of conductive material covered with insulating material on only a side facing the gap opposite a side facing the chamber or a layer of conductive material covered with insulating material on the side facing the gap and on the side facing the chamber.

3. The actuator of claim 1, wherein a second conductor second part is disposed between each pair of first conductors positioned adjacent to one another.

4. The actuator of claim 1, wherein a first conductor associated with each chamber comprises a plurality of first conductors associated with each chamber.

5. The actuator of claim 4, wherein a second conductor second part is disposed between each pair of first conductors positioned adjacent to one another in a first direction and between each pair of first conductors positioned adjacent to one another in a second direction substantially perpendicular to the first direction.

6. The actuator of claim 1, wherein a first conductor associated with each chamber comprises only one first conductor associated with each chamber.

7. An electrostatic actuator, comprising a plurality of MEMS capacitors in which a plurality of distinct first conductors are separated at least in part by a single second conductor, the second conductor having flexible first parts each extending parallel to and opposite a corresponding first conductor across a gap and second parts each disposed between first conductors.

8. The actuator of claim 7, wherein the second conductor comprises an insulated second conductor having a layer of conductive material covered on only one side with insulating material or a layer of conductive material covered on both sides with insulating material.

9. The actuator of claim 7, further comprising a drive circuit for selectively charging and discharging the capacitors to flex the flexible first parts.

10. The actuator of claim 9, further comprising a plurality of chambers for chambering a fluid, each chamber having an orifice therein through which fluid may be ejected from the chamber and each chamber having a wall comprising a flexible first part of one of the capacitors.

11. An electrostatic actuator for ejecting fluid from a chamber, comprising:

a plurality of rigid conductors arranged adjacent to one another along the chamber;

a flexible conductor disposed opposite to and spanning the plurality of rigid conductors across a gap, the flexible conductor forming at least part of one wall of the chamber such that flexing the flexible conductor flexes the wall to change the volume of the chamber; and a signal generator operatively connected to the rigid conductors and to the flexible conductor for selectively applying a voltage between rigid conductors and the flexible conductor to generate a varying electrostatic force that flexes the flexible conductor in a desired pattern to eject drops of fluid from an orifice in the chamber.

12. The actuator of claim 11, wherein the flexible conductor comprises a single flexible conductor disposed opposite to and spanning the plurality of rigid conductors across a gap, the single flexible conductor forming at least part of one wall of the chamber such that flexing the flexible conductor flexes the wall to change the volume of the chamber.

13. The actuator of claim 11, wherein the signal generator operatively connected to the rigid conductors and to the flexible conductor for selectively applying a voltage between rigid conductors and the second conductor to generate a varying electrostatic force that flexes the flexible conductor in a desired pattern to eject drops of fluid from the chamber comprises a signal generator operatively connected to the rigid conductors and to the flexible conductor for selectively applying a voltage between rigid conductors and the flexible conductor to generate peristaltic pumping to eject drops of fluid from an orifice in the chamber.

14. A fluid drop ejector, comprising:

a fluid channel structure having a plurality of first channels arranged therein generally parallel to one another;

an actuator die affixed to the fluid channel structure, the actuator die having a plurality of second channels formed therein, each of the second channels aligned with a corresponding one of the first channels to form a plurality of fluid chambers, and an electrostatic actuator that includes:

a first conductor having a plurality of flexible first parts supported by a plurality of second parts, each flexible first part defining at least part of one wall of each of the second channels; and a plurality of second conductors each aligned across a gap opposite a corresponding one of the first parts of the first conductor; and an orifice in each chamber through which fluid may be ejected from the chamber at the urging of the actuator.

15. The ejector of claim 14, wherein a second conductor second part is disposed between each pair of first conductors positioned adjacent to one another.

16. The ejector of claim 14, wherein the actuator further comprises a voltage source operatively connected to each of the second conductors for selectively applying a voltage between each of the second conductors and the first conductor.

* * * * *